United States Patent [19]

Lucchini et al.

[11] 4,319,084

[45] Mar. 9, 1982

[54] MULTICHANNEL DIGITAL SPEECH SYNTHESIZER

[75] Inventors: Paolo Lucchini, Udine; Luciano Nebbia, Turin, both of Italy

[73] Assignee: CSELT, Centro Studi e Laboratori Telecomunicazioni S.p.A, Turin, Italy

[21] Appl. No.: 130,397

[22] Filed: Mar. 14, 1980

[30] Foreign Application Priority Data

Mar. 15, 1979 [IT] Italy ..... 67543 A/79

[51] Int. Cl.[3] ..... G10L 1/00

[52] U.S. Cl. ..... 179/1 SM; 179/1 B

[58] Field of Search ..... 179/1 SM, 1 SG, 1 B; 370/77, 81, 110; 364/724

[56] References Cited

U.S. PATENT DOCUMENTS 3,928,722 12/1975 Nakata et al. ..... 179/1 SM

OTHER PUBLICATIONS

Gray, A. et al., "Digital Lattice and Ladder Filter", IEEE Trans. on Audio and Electro., Dec. 1973, pp. 491-500.

Bertinetto, P. et al., "An Interactive Synthesis System etc.", CSELT Rapporti Technici, pp. 325-331.

Flanagan, J., "Synthetic Voices for Computers", IEEE Spectrum, Oct. 1970, pp. 22, 27-29.

*Primary Examiner*—Charles E. Atkinson
*Assistant Examiner*—E. S. Kemeny
*Attorney, Agent, or Firm*—Karl F. Ross

[57] ABSTRACT

A multichannel digital speech synthesizer comprises a pulse generator storing periodic and aperiodic excitation signals to be processed in a lattice filter according to weighting parameters, such as gain and reflection coefficients, transmitted from a computer via a control unit and a plurality of input modules assigned to respective output channels. Each input module includes a resettable counter for timing the emissions of periodic or aperiodic excitation signals, to generate a voiced or an unvoiced speech element, and for requesting a new set of parameters from the computer upon detecting the end of a validity interval for a current set of parameters; the module further comprises a pair of buffer memories alternating in reading and writing operations under the control of the counter to ensure a continuous flow of parameter sets to the filter.

10 Claims, 7 Drawing Figures

MULTICHANNEL DIGITAL SPEECH SYNTHESIZER

FIELD OF THE INVENTION

Our present invention relates to a digital synthesizer of sound waves for electronically producing artificial speech.

BACKGROUND OF THE INVENTION

In the field of telecommunications, the synthesis of speech is of particular interest. It permits people unskilled in computer technology to receive so-called canned messages, e.g. by telephone, without the necessity of employing full-time human operators or of using costly subscriber terminals. Such messages may inform a calling subscriber of congestion at an exchange, of the cost and duration of a call, and of a changed directory number.

A digital system for synthesizing speech stores words or portions of words in coded form, a decoder being necessary to convert the digitally encoded signals into voice signals suitable for conventional transduction into sound waves. One particular system for the synthesis of speech elements stores PCM-coded waveform samples of diphones, i.e. phoneme pairs. Such a system generates a staccato-sounding speech and has the further disadvantage of requiring a large memory.

In an attempt to achieve natural-sounding synthesis, coding techniques have been developed on the basis of mathematical models simulating the production of speech by a human vocal tract. According to one model, the vocal tract is replaced by the combination of an excitation generator and a time-variable filtering system consisting of the resonant cavities of an acoustic tube having a variable cross-section. The excitation may be a sequence of periodic or pseudorandom pressure variations, depending on whether the output is to correspond to a voiced or an unvoiced sound. The filter has coefficients which represent the effects of reflection between different cavities of the tube and are continuous functions of time; the coefficient values, however, may be considered to be constant during sufficiently short time intervals, e.g. on the order of 10 msec. Furthermore, the filter can be controlled to have a variable gain corresponding to a varying sound intensity.

Thus, an element of synthesized speech may be represented by a set of parameters coding the duration of the element, the kind of excitation (whether voiced or unvoiced), filter gain, weighting coefficients and, in the case of voiced sound, the recurrence period of the excitation pulses. These parameters are obtained by analyzing human speech in accordance with the selected model. Such an analysis is described by P. M. Bertinetto, C. Miotti, S. Sandri and E. Vivalda in a paper titled "An Interactive Synthesis System for the Detection of Italian Prosodic Rules", CSELT Technical Reports, vol. V, No. 5, December 1977. Prior synthesizers operating according to this model, however, vary the coefficients at constant intervals, thereby producing a degree of unnaturalness in the synthesized speech.

OBJECTS OF THE INVENTION

The object of our present invetion is to provide an improved speech synthesizer of the type referred to.

SUMMARY OF THE INVENTION

A digital speech synthesizer according to our present invention comprises signal-generating means delivering excitation pulses of varying amplitudes and polarities to a lattice filter for producing digital speech samples in response thereto. A digital-to-analog converter at the output of the filter translates the speech samples into voice signals. A computer of other programmed message source stores sets of processing parameters transmittable, in a predetermined sequence, to the signal-generating means for commanding the emission of the excitation pulses, and to the filter for controlling the processing of these pulses thereby; the processing parameters represent coded information relating to frequency distribution, volume and duration of speech elements such as diphones. An input unit, which may be one of several identical modules, operatively connects the signal-generating means and the filter to the message source for producing consecutive speech elements of a voice signal coded by the parameter-set sequence. The input unit includes counting means for controlling the respective duration of each speech element according to counter settings transmitted by the message source together with the processing parameters, these setting establishing different counts of validity intervals for the respective parameter sets A time base correlates the operation of the filter, the input unit and the signal generator.

According to another feature of our present invention, the signal-generating means includes a first generator adapted to emit periodic excitation pulses, i.e. digitized amplitude samples of alternating waveforms to produce voiced elements, and a second generator adapted to emit aperiodic excitation signals, i.e. constant-amplitude pulses free from recognizable periodicity, to produce unvoiced elements of synthesized speech. The parameters from the message source include a discriminating signal for the selective enablement of one or the other generator, which may be a read-only memory, according to the nature of the sound to be generated.

Preferably, the synthesizer according to our present invention includes a plurality of input units of the aforedescribed type each associated with a respective output channel, the time base being connected to the input units for individually activating them one at a time. In such a case, the excitation-pulse generators and the filter are controlled by the time base to operate in a time-division mode for establishing time slots respectively allocated to the several input units.

According to another feature of our present invention, the counting means of each input unit include two distinct counters, namely a validity-interval counter and a sound-interval counter. The latter is preloaded with a setting or preliminary count to be progressively decremented for measuring the length of an operating period for either the periodic-signal or the aperiodic-signal generator, depending on the nature (voiced or unvoiced) of the sound. A control unit advantageously forms an interface between the message source and the input units for temporarily storing parameter-set requests therefrom and for distributing parameter sets from that source to respective input units selected according to programmed address information. Each input unit may further include a pair of buffer memories for temporarily and alternatively storing successive parameter sets from the messsage source, the validity-interval counter being connected to these buffer memories for enabling an interchange of reading and writing functions therebetween upon detecting the termination of a current validity interval and for receiving upon such interchange, from whichever of these memories is enabled for reading, a counter setting determining the duration of the next validity interval.

According to yet another feature of our present invention, a switch operating in response to the aforementioned discriminating signal from the buffer memory enabled for reading controls the preloading of the sound-interval counter with unvoiced-interval settings equal to the encoded contents of the validity-interval counter or with pitch-period settings (i.e. a count of the cycle length of the fundamental sound frequency) from the enabled memory, these settings representing coded frequency characteristics of speech elements. An additional memory temporarily stores weighting coefficients and sound-intensity data transmitted from the read-enabled buffer memory in response to a reading signal generated by the sound-interval counter upon detecting the termination of a current sound interval; the additional memory is connected to the time base and to the filter for transmitting the weighting coefficients thereto in response to clock signals from the time base.

Pursuant to further features of our present invention, the control unit includes a logic network for enabling the transfer of a parameter request from an input unit to the message source only upon receiving therefrom consent signals indicating completion of an ongoing transmission of a parameter-set sequence to such input unit. A register temporarily stores the arriving parameters while a series-to-parallel converter decodes address signals from the message source to enable the transmission of the parameters from the register to a selected input unit. A parallel-to-series converter encodes the addresses of request-emitting input units, these addresses being temporarily stored in a read/write memory prior to their emission to the message source in response to a consent signal therefrom.

The lattice filter used in our improved speech processor may comprise a digital multiplier, a digital adder and a data store together generating a digital speech sample as a sum of terms including an excitation sample weighted by a sound-intensity coefficient and at least one term formed as a product of a reflection coefficient and a preceding digital speech sample. For the theoretical principles underlying the operation of such a filter, reference may be made to an article titled "Digital Lattice and Ladder Filter Synthesis" by A. H. Gray and John D. Markel, IEEE Transactions on Audio and Electroacoustics, Vol. AU-21, No. 6, December 1973, pages 491–500.

BRIEF DESCRIPTION OF THE DRAWING

The above and other features of our present invention will now be described in detail, reference being made to the accompanying drawing in which.

SPECIFIC DESCRIPTION

Figure 1:
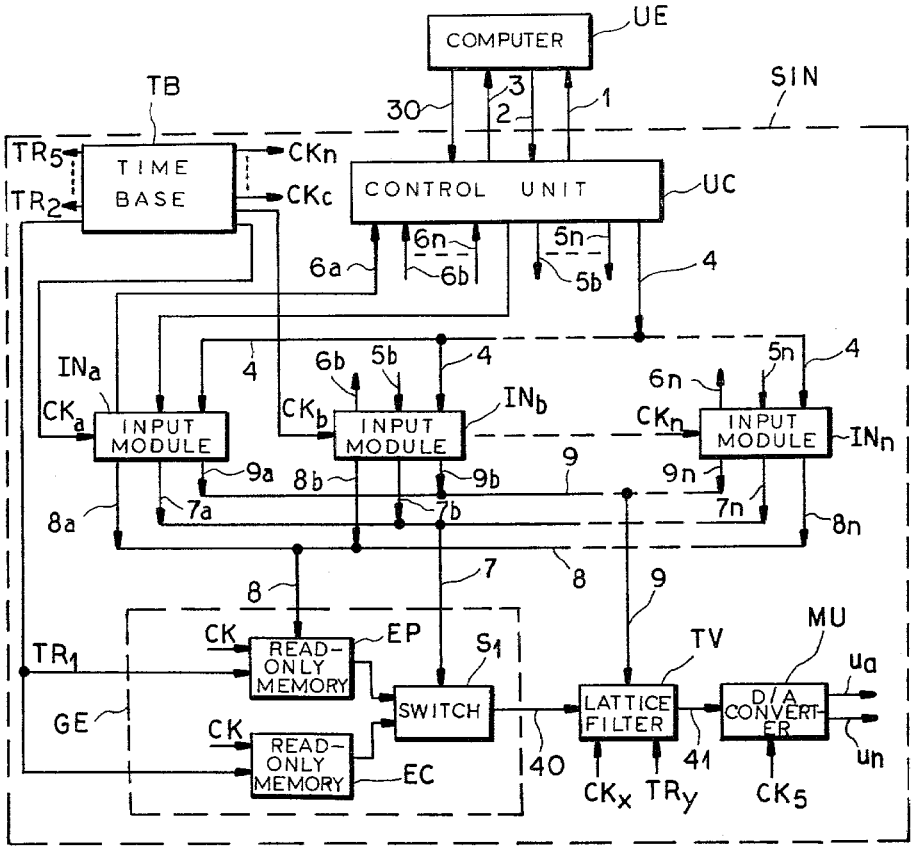
FIG. 1 is a block diagram of a multichannel digital speech synthesizer according to our present invention, including a lattice filter operatively connected to a processor via a control interface and n input modules.

FIG. 1 shows a multichannel digital speech synthesizer SIN connected to an external message source UE such as a computer or programmer for receiving therefrom sets of parameters coding information related to frequency distributions, intensity levels and durations of consecutive speech elements. The synthesizer comprises, according to our present invention, a lattice filter TV processing excitation pulses to produce digital speech samples transmitted over a lead 41 to a digital-to-analog converter MU for translation into voice signals and distribution over n outgoing signal paths in the form of transmission lines $u_a \ldots u_n$. Converter MU is an output unit advantageously consisting of n D/A stages and a series-to-parallel decoder (not shown) distributing thereto time-division-multiplexed signals arriving from filter TV.

Filter TV receives excitation pulses via an input lead 40 extending from a signal generator GE which includes a pair of read-only memories EP and EC functioning respectively as a periodic-signal emitter and aperiodic-signal emitter designed to supply filter TV with pulse trains processed thereby into digital speech samples convertible by unit MU into voiced and unvoiced elements of synthesized speech. Binary-coded signals arriving from an input module $IN_a$, $IN_b$, . . . $IN_n$ via respective lead groups 8*a*, 8*b*, . . . 8*n*, merging in a common multiple 8, represent a pitch-period parameter T characterizing the fundamental frequency of a voiced speech element. In response to these signals, read-only memory EP emits a train of T pulses including a first pulse having a positive polarity and a magnitude $\sqrt{T-1}$ and $(T-1)$ pulses having a negative polarity and a magnitude $1/\sqrt{T-1}$. Thus, the train of T pulses generated by memory EP, e.g. at a cadence of 8 KHz, forms an excitation signal having a zero mean value and unitary power whereby variations in the d-c voltage level between successive sound elements are eliminated and the sound intensity or volume becomes precisely controllable according to a gain coefficient G (see FIG. 4) transmitted from computer UE to filter TV via input modules $IN_a$, $IN_b$, . . . $IN_n$, as described more fully hereinafter with reference to FIGS. 4 and 5.

Read-only memory EC generates trains of pulses of unitary magnitude and pseudo-random polarity. Each train constitutes an excitation signal of unitary power and substantially zero mean value. The periodicity of the pulse sequence will be practically imperceptible if that sequence is of sufficiently great length, e.g. of the order of $2^{10}$ pulses.

Memories EP and EC are selectively connectable to filter TV by an electronic switch $S_1$ under the control of a signal transmitted from an input module $IN_a$–$IN_n$ over a wired-OR connection comprising leads 7*a*, 7*b*, . . . 7*n* and a common conductor 7. Modules $IN_a$–$IN_n$ also transmit to filter TV, over respective leads 9*a*, 9*b*, . . . 9*n* and a common conductor 9, the coded values of multiplicative reflection coefficients $K_1$, $K_2$ etc. (FIG. 4) and of the gain coefficient G which are used by filter TV in processing the excitation signals from generator GE.

The number of reflection coefficients $K_1$, $K_2$ etc. depends on the number of functional cells in filter TV, i.e. on the number of recursive digital algebraic operations performed by the filter for each speech sample emitted to converter MU, as described in detail hereinafter with reference to FIGS. 4 and 5. Associated with each excitation pulse transmitted over lead 40 to filter TV is a respective set of weighting coefficients G, $K_1$, $K_2$ etc. These coefficients, together with a discriminating bit carried by conductor 7, the signals coding the pitch period T (on multiple 8) and bits determining the duration of an interval D of validity for coefficients G, $K_1$, $K_2$ etc., constitute a set of processing parameters transmitted from computer UE to an input module $IN_a$, $IN_b$, . . . $IN_n$ a multiple 1 and a control unit UC which forms an interface between these input modules and the computer.

Unit UC receives, via a multiple 2 extending from computer UE, timing pulses inducing the loading of parameter signals carried by multiple 1, the latter multiple also transmitting control signals which are decoded by unit UC and serve at least in part for commanding the emission, over leads 5*a*, 5*b*, . . . 5*n*, of activating pulses enabling the selective loading of input modules $IN_a$, $IN_b$, . . . $IN_n$ with parametric signals received from unit UC via a line 4. These modules, as described hereinafter with respect to FIGS. 2 and 3, emit parameter-request signals to processor UE via respective output leads 6*a*, 6*b*, . . . 6*n*, control unit UC and a multiple 3. On a lead 30, extending to control unit UC, computer UE transmits a verification code confirming the reception of a parameter request.

The operations of synthesizer SIN are correlated by a time base TB emitting selection signals $CK_a$, $CK_b$, . . . $CK_n$ to input modules $IN_a$, $IN_b$, . . . $IN_n$, respectively, reading signals $CK_1$ and $TR_1$ to memories EP, EC, and clock pulses $CK_x$ (x=1, 2 . . . 5) as well as enabling signals $TR_y$ (y=2, 3 . . . 6) to filter TV.

Figure 2:
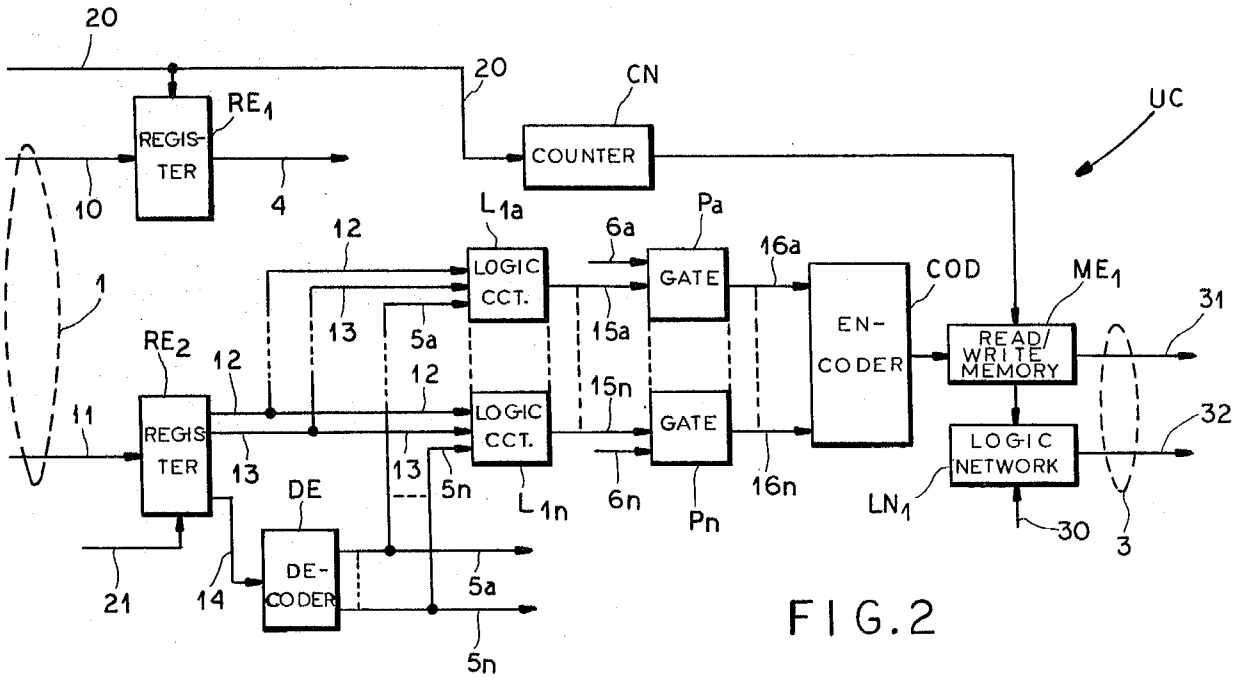
FIG. 2 is a block diagram of the control unit or interface illustrated in FIG. 1.

As shown in FIG. 2, control unit UC comprises a first register $RE_1$ loading, in response to timing pulses carried by a lead 20, parametric signals transmitted on a lead 10. A second register $RE_2$ temporarily stores control words arriving on a lead 11, this register being enabled by timing pulses carried on a lead 21. Leads 10, 11 and 20, 21 form part of multiples 1 and 2, respectively. Register $RE_1$ has an output connected to line 4, while register $RE_2$ has a pair of output leads 12, 13 extending to n logic circuits $L_{la}$–$L_{ln}$ associated with respective input modules $IN_a$–$IN_n$ and with respective output channels $u_a$–$u_n$. Register $RE_2$ has a further output lead 14 extending to a decoder DE which in turn has output connections 5*a*–5*n* working into logic circuits $L_{la}$–$L_{ln}$ and into input modules $IN_a$–$IN_n$, as heretofore described. Circuits $L_{la}$–$L_{ln}$ are connected via associated leads 15*a*–15*n* to respective AND gates $P_a$–$P_n$ whose output leads 16*a*–16*n* are linked to a read/write memory $ME_1$ via an encoder COD. This memory has a read-command input from a counter CN fed by the timing pulses on lead 20 and an output tied to computer UE via a lead 31 forming part of multiple 3 (FIG. 1). A logic network $LN_1$ is connected to memory $ME_1$ for inforing computer UE, via a lead 32 of multiple 3, that memory $ME_1$ contains at least one message.

Upon the transmission over lead 10 of the first in a sequence of parameter sets chosen by computer UE for synthesizing a predetermined voice signal to be emitted over a selected output channel $u_a$–$u_n$, pulses on lead 20 enable the loading of the parameters by register $RE_1$. A control word simultaneously carried on lead 11 is loaded into register $RE_2$ in response to timing pulses on lead 21. This control word includes a bit commanding the initiation of a parameter-set sequence and inducing the energization of lead 12. A signal emitted over lead 14 causes decoder DE to energize a lead 5*a*–5*n* corresponding to the selected output channel, e.g. channel $u_a$. Owing to the presence of high-level logic signals on leads 12 and 5*a*, circuit $L_{la}$ emits a high-level voltage on lead 15*a*, thereby enabling gate $P_a$ to emit a pulse to encoder COD in response to a pulse transmitted from input module $IN_a$ over lead 6*a*. Module $IN_a$ will energize lead 6*a*, as described in detail hereinafter with reference to FIG. 3, upon detecting the termination of a validity interval D for a set of parameters already received by module $IN_a$ from computer UE. Upon receiving from gate $P_a$ a pulse signifying a parameter request from module $IN_a$, encoder COD writes in memory $ME_1$ an address code corresponding to channel $u_a$. The reception and storage of the address code is detected by logic network $LN_1$ and communicated thereby to computer UE via lead 32. Upon the counting of a predetermined number of timing pulses indicating the completed transmission of an entire parameter set via register $RE_1$, counter CN generates a consent signal enabling the reading of an address code from memory $ME_1$. This memory is provided with n storage locations, i.e. one for every channel $u_a$–$u_n$.

Figure 3:
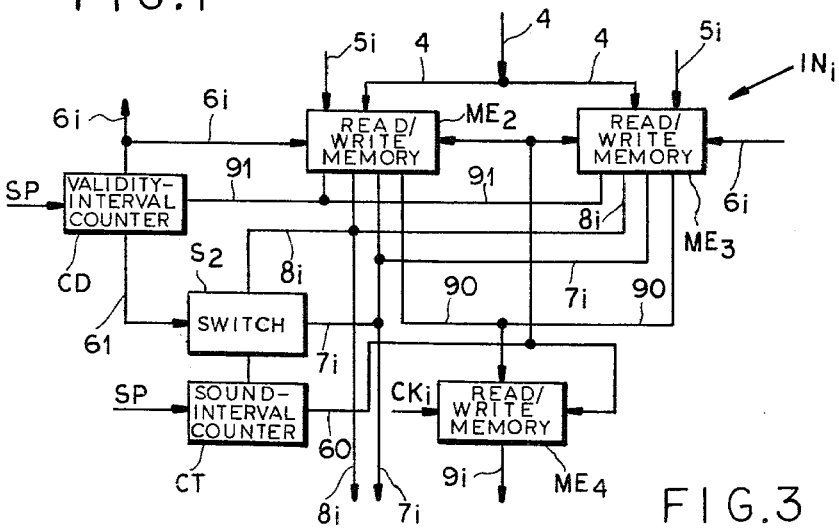
FIG. 3 is a block diagram of an input module shown in FIG. 1.

As shown in FIG. 3, a generic input module $IN_i$ representative of all modules $IN_a$–$IN_n$ includes a pair of read/write memories $ME_2$, $ME_3$ serving as buffer stores for parameter sets arriving over line 4. Lead 6*i*, which carries a parameter request from a validity-interval counter CD, works into memories $ME_2$, $ME_3$ for effecting an interchange of writing and reading functions therebetween, so that these memories alternate in the reception and readout of parameter sets. The energization of lead 6*i* also causes the emission to counter CD, via a lead 91 and from the memory $ME_2$ or $ME_3$ enabled for reading, of a counter setting determining the validity interval D of the parameter set stored by this memory. Memories $ME_2$, $ME_3$ have a common output connection 90 extending to an additional memory $ME_4$ for transferring parameter sets thereto; this transfer to memory $ME_4$ from the buffer memory $ME_2$ or $ME_3$ enabled for reading is caused by a sound-interval counter CT via a lead 60. The emission of a parameter set from memory $ME_4$ to filter TV via lead 9*i* occurs in response to clock signal $CK_i$.

Counter CT is connected at a loading input to an electronic switch $S_2$ for receiving a sound-interval count from counter CD via a lead 61 or from read-enabled memory $ME_2$ or $ME_3$ via multiple 8*i*. According to whether the energization level of lead 7*i* indicates that the sound nature of a forthcoming speech sample is to be unvoiced or voiced, switch $S_2$ presets counter CT with an unvoiced-interval count equal to the current contents of component CD or with a voiced-interval count determined by the pitch-period signals carried by multiple 8*i*. The contents of counters CD, CT are decremented by stepping pulses SP emitted by time base TB.

Upon the loading of a control word into register $RE_2$ (FIG. 2) and the transmission to decoder DE of an address code indicating the output channel associated with module $IN_i$, lead 5*i* is energized to apply a writing command to buffer memories $ME_2$, $ME_3$ (FIG. 3). Let us assume that this control word corresponds to a first parameter set in a sequence. Counters CD and CT are then set to measure a predetermined time interval $t_0$–$t_1$, indicated in FIG. 7, sufficient for the loading of the first parameter set into the memory $ME_2$ or $ME_3$, whichever happens to be enabled for writing; the counters CD, CT are preloaded with a common setting $T_0=D_0$ at instant $t_0$. Upon counting out the predetermined starting interval $t_0$–$t_1$, counter CD emits on lead 6*i* a pulse passed by the associated gate ($P_a$–$P_n$, FIG. 2) and converted by encoder COD into a parameter request transmitted to computer UE via lead 31, as heretofore described. The pulse on lead 6*i* also interchanges reading and writing functions between memories $ME_2$, $ME_3$ and, if memory $ME_2$ is assumed to accept the first parameter set, reads onto lead 91 a code group or byte from this memory to preload the counter CD with a validity-interval setting $D_1$ assigned to this parameter set.

At the same instant $t_1$ when counter CD emits a pulse on lead 6*i*, counter CT temporarily energizes lead 60, thereby reading from memory $ME_2$ onto leads 90, 7*i* and 8*i* respective code groups which represent a set of filter coefficients G(1), $K_1$(1), $K_2$(1) etc. controlling the processing in filter TV of a first excitation-pulse train, a discriminating signal indicating that the sound nature of a first speech element is voiced, and signals giving a pitch period $T_1$ for the fundamental frequency of this first speech element. The signal carried by lead 7*i* induces switch $S_2$ to preload counter CT with a setting corresponding to pitch period $T_1$, this counter immediately beginning to decrement the count $T_1$ to measure a time interval $t_1$–$t_1'$. During this interval the memory $ME_4$ is recurrently addressed by clock signal $CK_i$, at a rate inversely proportional to the number n of synthesizer channels $u_a$–$u_n$, to feed coefficients G(1), $K_1$(1), $K_2$(1) etc. to filter TV for determining the processing of excitation pulses transmitted from read-only memory EP according to the pitch period $T_1$.

If there are eight output channels (n=8) and if the synthesizer SIN has a cycle length of 125 μsec, filter TV will have available an interval of almost 16 μsec per cycle for processing, according to weighting coefficients supplied by memory $ME_4$, an excitation pulse emitted by memory EP (FIG. 1) in response to the pitch-period code carried by leads 8*a*, 8. As heretofore described, memory EP is addressed by this pitch-period code and by an enabling signal $TR_1$ to emit an excitation signal consisting of $T_1$ pulses. Generally, the voiced-sound interval counted by component CT, as determined by its presetting with the corresponding pitch-period count T, is substantially greater than the interval required for the emission of a complete excitation code by memory EP, whereby 10 to 100 identical excitation codes are processed by filter TV prior to the reading of another parameter set from buffer memories $ME_2$, $ME_3$.

Upon reaching its preset count of $T_1$, component CT transmits a pulse via lead 60 to memories $ME_2$–$ME_4$. Because component CD has not yet finished counting, memories $ME_2$ and $ME_3$ are still enabled for reading and writing, respectively. Thus, the pulse on lead 60 again delivers the setting $T_1$ to counter CT and coefficients G(1), $K_1$(1), $K_2$(1) etc. to memory $ME_4$ whereupon the operations implemented during interval $t_1$–$t_2$ are repeated in a subsequent interval $t_1'$–$t_1''$ of identical duration.

At an instant $t_2$ determined by validity-interval setting $D_1$, counter CD energizes lead 6*i* to communicate a parameter-set request to computer UE and to interchange reading and writing operations between memories $ME_2$ and $ME_3$. A signal carried by lead 91 from memory $ME_3$ in response to the energization of lead 6*i* now preloads counter CD with a setting $D_2$ determining the next interval of validity for the parameters stored in memory $ME_3$. These parameters are read from memory $ME_3$ by counter CT at instant $t_1''$ and include a discriminating signal, emitted on lead 7*i*, indicating the sound of the next synthesized speech element to be unvoiced. This signal reverses switch $S_2$ to load counter CT with the current contents of counter CD and connects lead 40 (FIG. 1) to read-only memory EC. It is to be noted that, in the illustrative example of input-unit operation shown in FIG. 7, interval $t_1''$–$t_3$ is represented with dashed lines to indicate the emission of unvoiced samples by filter TV; time $t_2$–$t_3$ is similarly represented to indicate a validity interval for unvoiced-sound parameters. During interval $t_2$–$t_3$, memory EC emits at least one excitation signal consisting of pulses of unitary magnitude and quasi-random polarity to be processed by filter TV according to a gain coefficient G(2) and reflection coefficients $K_1$(2), $K_2$(2) etc. which are fed to memory $ME_4$ upon the energization of lead 60 at instant $t_1''$ and are subsequently transmitted to filter TV under the control of clock pulses $CK_i$. During interval $t_2$–$t_3$, determined by the count $D_2$, memory $ME_2$ receives a new parameter set from computer UE via control unit UC.

Because counter CT is loaded at instant $t_1''$ with the contents of counter CD, these two components energize their respective output leads 60, 6*i* substantially simultaneously. Consequently, at instant $t_3$ the counter CD is preloaded to measure a time $t_3$–$t_4$ according to a validity-interval setting $D_3$ transmitted from buffer $ME_2$ and counter CT is given a setting $T_3$ determining an interval $t_3$–$t_3'$, while memory $ME_4$ is fed signals from buffer $ME_2$ representing a third set of filter coefficients G(3), $K_1$(3), $K_2$(3) etc. Signals generated on lead 8*i* represent pitch characteristics of a speech element to be synthesized during interval $t_3$–$t_3'$, as well as the setting supplied to counter CT, and induce read-only memory EP to emit excitation signals constituted by a positive pulse of magnitude $\sqrt{T_3-1}$ and $(T_3-1)$ negative pulses of magnitude $1/\sqrt{T_3-1}$, as heretofore described with reference to FIG. 1. One excitation pulse is emitted during each synthesizer cycle, i.e. each 125 μsec, to be processed into a digital speech sample by filter TV in response to weighting coefficients G(3), $K_1$(3), $K_2$(3) etc. read from memory $ME_4$ by clock pulses $CK_i$.

Figure 7:
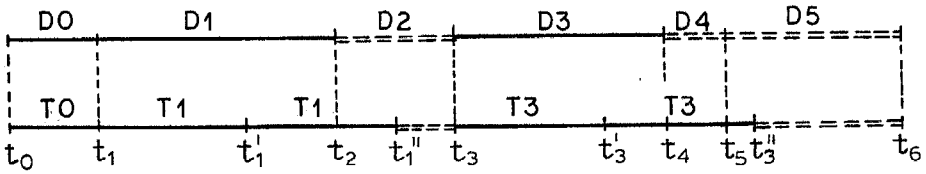
FIG. 7 is a graph of durations of parallel operating states of an input module shown in FIGS. 1 and 3.

At instant $t_3'$, owing to validity interval $t_3$–$t_4$ being longer than voiced-sound interval $t_3$–$t_3'$, counter CT again is preloaded with count $T_3$ and memory $ME_4$ receives weighting coefficients G(3), $K_1$(3), $K_2$(3) etc., whereby digital speech samples generated at the output of filter TV during interval $t_3$–$t_3'$ are represented during a succeeding interval $t_3'$–$t_3''$. At instant $t_4$, counter CD enables buffers $ME_2$, $ME_3$ for writing and for reading, respectively, and receives a setting $D_4$ which determines the duration of a validity interval $t_4$–$t_5$. During the latter interval a new parameter set is written into buffer $ME_2$; as indicated in FIG. 7, however, this set is replaced at instant $t_5$ by yet another set which controls the sound characteristics of a speech element produced by synthesizer SIN on the associated output channel during a subsequent interval $t_3''$–$t_6$. Owing to the brief duration of validity interval $t_4$–$t_5$, the suppression of the corresponding sound is largely unnoticeable.

Figure 4:
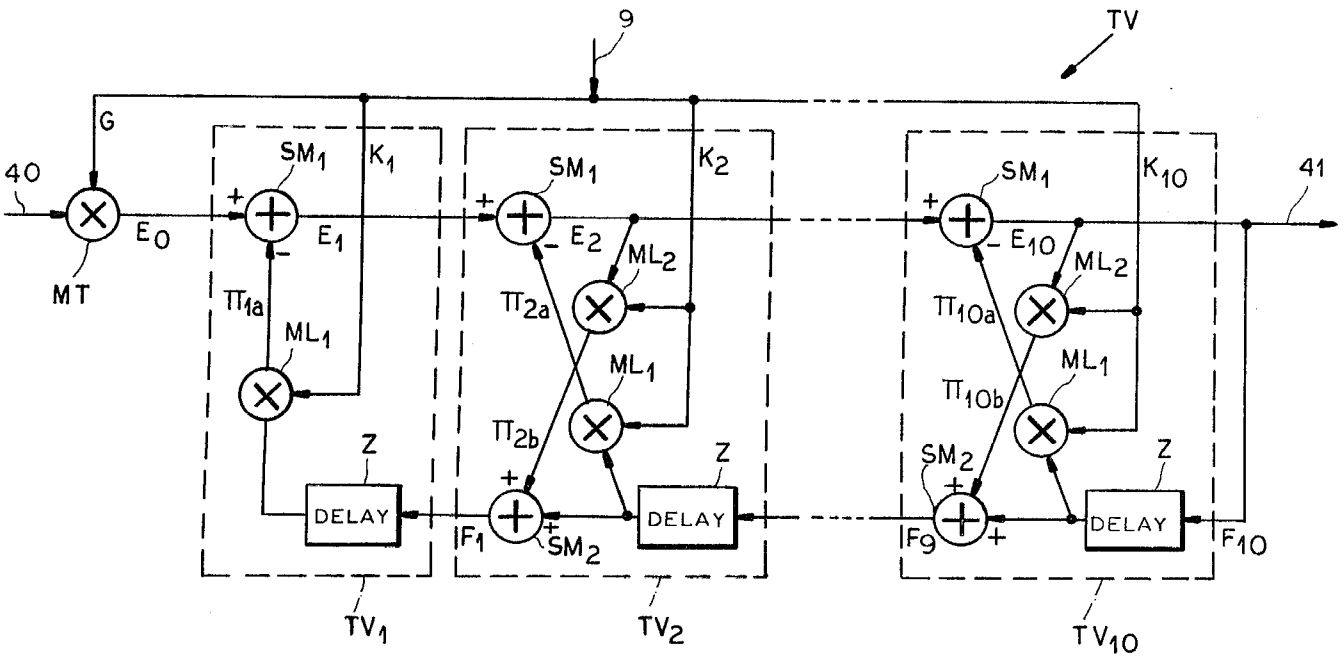
FIG. 4 is a hypothetical diagram illustrating the principle of operation of the filter of FIG. 1.

The processing of excitation pulses by filter TV is diagrammatically illustrated in FIG. 4. To produce a digital speech sample $E_{10}$ on the lead 41 extending to converter MU (FIG. 1), filter TV forms a product $E_0$, at a multiplication stage MT, of an incoming excitation pulse and a gain factor G arriving via lead 9 from one of the input units $IN_a$, $IN_b$, . . . $IN_n$. Product $E_0$ is then successively diminished at differential stages $SM_1$ of ten functional cells $TV_1$ to $TV_{10}$ of filter TV. Stage $SM_1$ of each of these cells yields a resulting value $E_1$ to $E_{10}$ formed by subtracting from the result of the operation of the preceding cell MT, $TV_1$ etc. a product $\pi_{1a}$ to $\pi_{10a}$ in turn formed, at a respective multiplication stage $ML_1$, from a reflection coefficient $K_1$ to $K_{10}$ and a sum $F_1$ to $F_{10}$, these sums $F_1$ to $F_{10}$ being generated by feedback during the production of a preceding digital speech sample and temporarily stored at delay stages Z. Each cell $TV_2$ to $TV_{10}$ has an adder stage $SM_2$ at which the sums $F_1$ to $F_9$ are derived as algebraic combinations of the sums at the outputs of delays Z and products $\pi_{2b}$ to $\pi_{10b}$ formed at respective multiplication stages $ML_2$ of cells $TV_2$ to $TV_{10}$ from filter coefficients $K_2$ to $K_{10}$ and from the results $E_2$ to $E_{10}$ of subtractor stages $SM_1$. Thus, filter TV implements the following equations in processing an excitation pulse $E_0(\tau)$ at a time $\tau$ to yield a digital speech sample $E_{10}(\tau)$:

$$E_{10}(\tau) = G(\tau) \cdot E_0(\tau) - \sum_{j=1}^{10} K_j(\tau) \cdot F_j(\tau - \Delta\tau) \quad (1)$$

where $$F_j(\tau) = E_j(\tau) \cdot K_2(\tau) + F_{j+1}(\tau - \Delta\tau) \quad (2)$$

and $\Delta\tau$ represents the duration of a processing cycle of synthesizer SIN, e.g. 125 $\mu$sec. The values of the gain G and the multiplicative reflection coefficients $K_1$, $K_2$, . . . $K_{10}$, which are stored in computer UE and transmitted to filter TV via an input module $IN_a$, $IN_b$, . . . $IN_n$ as discussed above, are determined according to an acoustic-speech-production model as described in various publications listed in the aforementioned article by Bertinetto et al, including *Speech Synthesis* by J. L. Flanagan and L. R. Rabiner (Dowden, Hutchinson and Ross, Stroudsburg, PA., 1973) and *On Some Factors Influencing the Quality of Synthesized Speech* by C. Scagliola and E. Vivalda (First Colloque F.A.S.E., Paris, 1975).

Figure 5:
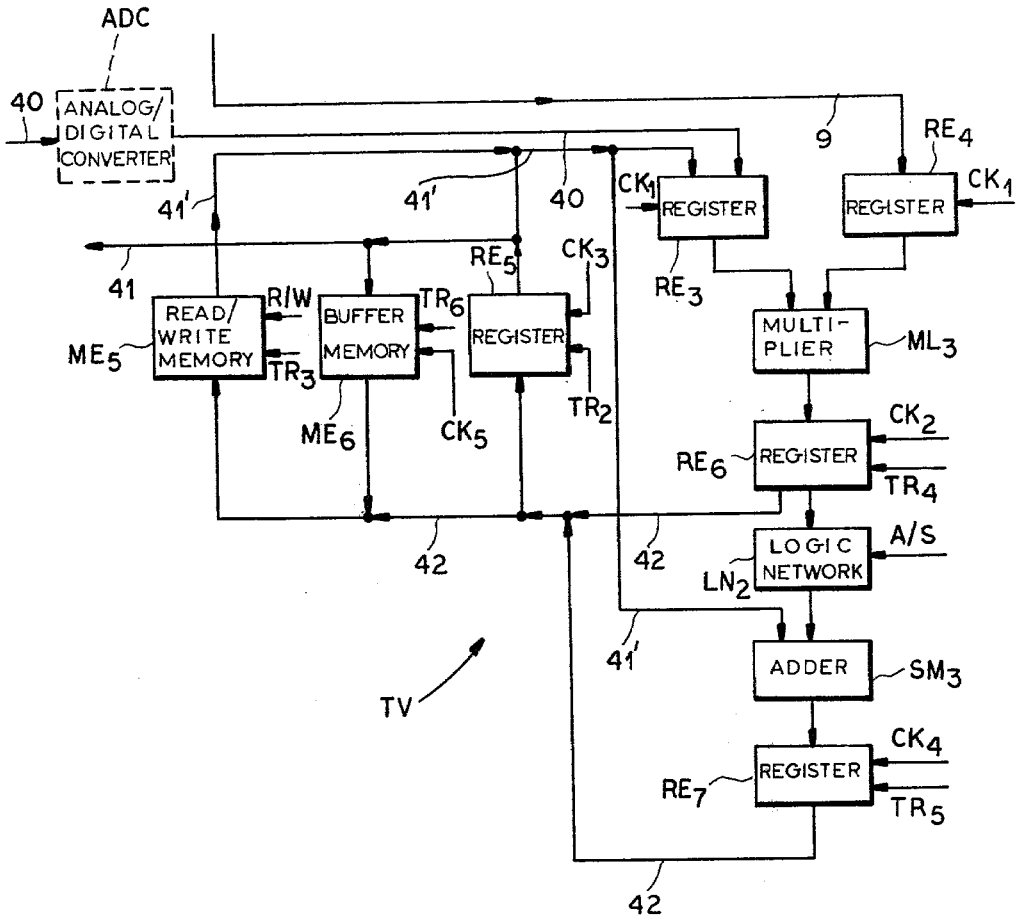
FIG. 5 is a block diagram showing the structure of the filter of FIG. 1.

An actual filter TV for executing the operation diagrammed in FIG. 4 is shown in FIG. 5. Lead 40 (see FIG. 1) extends to a register $RE_3$ via an analog-to-digital converter ADC which changes an incoming excitation pulse into a form suitable for the circuitry of filter TV; if the pulses emitted by memory EP (FIG. 1) are already coded in binary fashion, converter ADC may be omitted. Another register $RE_4$ has an input connected to lead 9 for receiving values of gain G and coefficients $K_1$, $K_2$ etc. from input modules $IN_a$ to $IN_n$. Both registers $RE_3$, $RE_4$ feed a multiplier $ML_3$ working into an output register $RE_6$. This register loads an adder $SM_3$ via a logic network $LN_2$ for selectively changing the algebraic sign, in response to the logic level of a changeover signal A/S from time base BT, of products emitted by multiplier $ML_3$. Register $RE_6$ has an output lead 42 extending to another register $RE_5$ and to a read/write memory $ME_5$ wherein reading and writing operations are controlled by a time-base signal R/W, register $RE_5$ and memory $ME_5$ working via a common output lead 41' into adder $SM_3$ and register $RE_3$. Adder $SM_3$ feeds yet another register $RE_7$ which shares output lead 42 with register $RE_6$.

Registers $RE_3$, $RE_4$ and $RE_6$ receive clock pulses $CK_1$, $CK_2$ and $TR_4$ for timing the operations of multiplier $ML_3$ to execute the products $E_0$, $\pi_{1a}$ to $\pi_{10a}$, $\pi_{1b}$ to $\pi_{10b}$ of stages MT, $ML_1$, $ML_2$ (see FIG. 4), while registers $RE_6$, $RE_7$ and logic network $LN_2$ respond to signals $CK_2$, $CK_4$, $TR_4$, $TR_5$ and A/S to control the adder $SM_3$ for producing the differences $E_1$ to $E_{10}$ and the sums $F_1$ to $F_9$ resulting from the operations performed at filter stages $SM_1$ and $SM_2$, respectively. Clock pulses $CK_1$, $CK_2$, $CK_3$ and $CK_4$ command the loading of registers $RE_3$/$RE_4$, $RE_6$, $RE_5$ and $RE_7$, respectively, while signals $TR_2$, $TR_3$, $TR_4$ and $TR_5$ are respectively applied to tristate circuits in register $RE_5$, memory $ME_5$, register $RE_6$ and register $RE_7$ for enabling the emission of the respective contents thereof onto leads 41' and 42. A further memory $ME_6$ has an input tied to lead 41, extending from register $RE_5$ to converter MU (FIG. 1), and an output connected via lead 42 to memory $ME_5$ for feeding back a result $E_{10}$ to serve as a sum $F_{10}$ in a subsequent processing of an excitation pulse.

Figure 6:
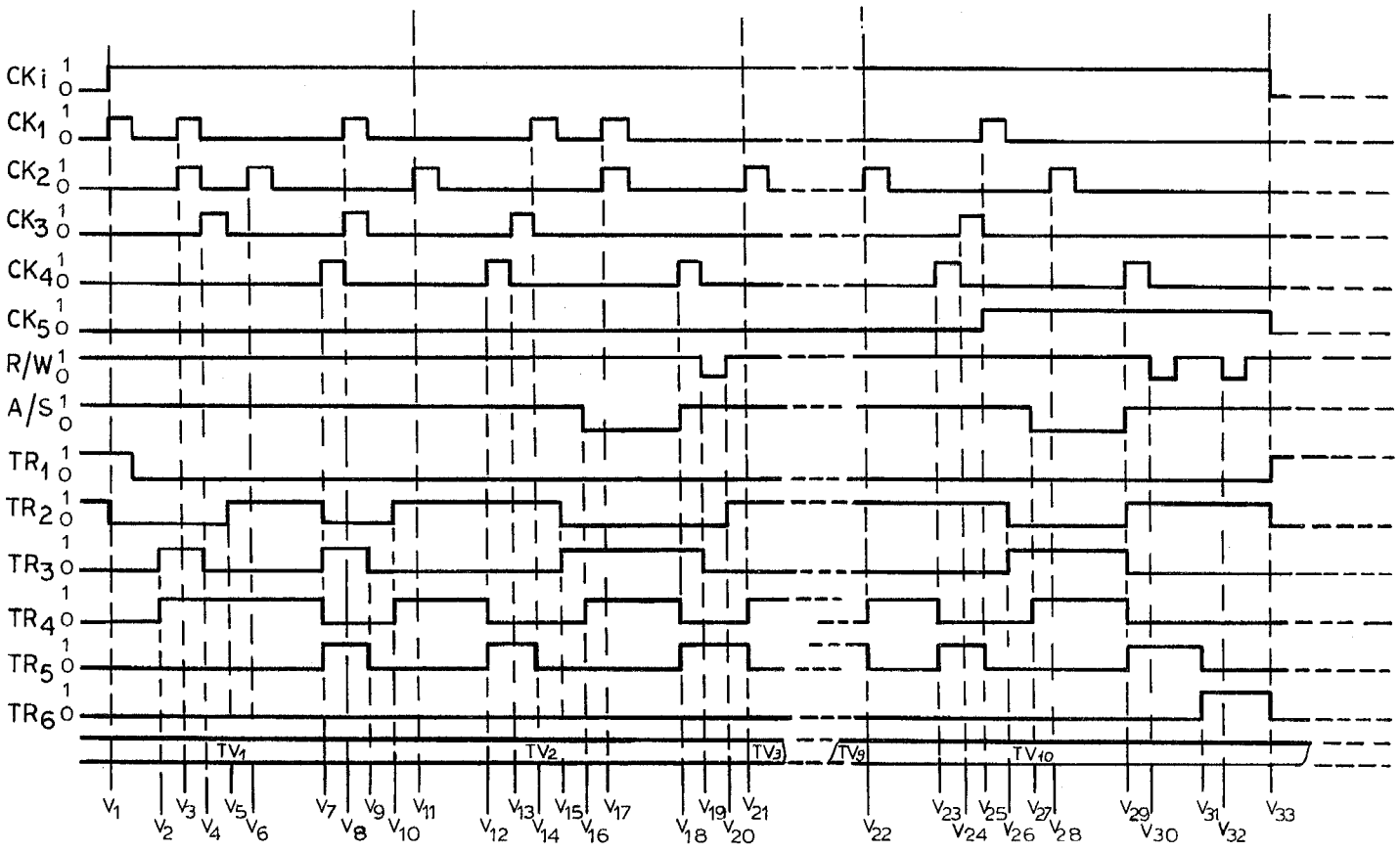
FIG. 6 is a graph of binary signals for controlling and synchronizing the operations of the synthesizer of FIG. 1.

Generally, memory $ME_5$ stores the sums $F_1$ to $F_{10}$, thereby carrying out the function of delays Z (FIG. 4). Register $RE_5$ temporarily memorizes the differences $E_0$ to $E_{10}$ during the processing of an excitation pulse. It is to be noted that filter TV performs the additive, subtractive and multiplicative operations, indicated in FIG. 4, for each speech sample emitted over any output channel $u_a$–$u_n$. These operations are executed in a time-division mode under the control of time base TB and will now be described in detail with reference to FIGS. 4, 5 and 6. In FIG. 6, a high level of read/write signal R/W denotes a reading command while a high level of changeover signal A/S causes a sign inversion.

Let us assume that, at an instant $v_1$, a channel-selection signal $CK_i$ (cf. FIG. 3) coincides with a clock pulse $CK_1$ and a high level of enabling signal $TR_1$, resulting in the emission of an excitation pulse from generator memory EP (FIG. 1) to input register $RE_3$ and the loading of a gain factor G into register $RE_4$. During an accommodation interval of at least 100 nsec, which follows instant $v_1$, enabling signals $TR_2$, $TR_3$ have a low logic level, thereby preventing the reading of algebraic values from register $R_5$ or memory $ME_5$ to input register $RE_3$. At an instant $v_2$, these signals $TR_2$, $TR_3$ taken on a high logic level, therby allowing memory $ME_5$ to feed back to that input register the coded sum $F_1$ (calculated in the preceding subcycle assigned to the selected channel) and commanding output register $RE_6$ to transmit the product $E_0$ from multiplier $ML_3$ onto lead 42. Upon the generation of clock pulses $CK_1$, $CK_2$ at an instant $v_3$, registers $RE_3$, $RE_4$ load sum $F_1$ and reflection coefficient $K_i$ from memory $ME_5$ and input module $IN_i$, respectively; register $RE_6$ memorizes the product $E_0$ present at the output of multiplier $ML_3$, this product being transferred to register $RE_5$ in response to a clock pulse $CK_3$ at an instant $v_4$. At the same instant the logic level of signal $TR_3$ goes low, thereby disconnecting memory $ME_5$ from output lead 41'.

An increase of the voltage of signal $TR_2$ at an instant $v_5$ enables the transfer of product $E_0$ from register $RE_5$ to adder $SM_3$ via lead 41'. The next clock pulse $CK_2$, following after a 100-nsec delay, causes the loading of product $\pi_{1a}$ into register $RE_6$. Because this register is already enabled by signal $TR_4$ and because logic network $LN_2$ is receiving a high-level signal A/S, product $\pi_{1a}$ is transmitted to adder $SM_3$ for subtraction from product $E_0$, the resulting difference $E_1$ being temporarily stored in register $RE_7$ in response to a clock pulse $CK_4$ at an instant $v_7$. Simultaneously with the rising edge of this pulse, the logic levels of signals $TR_2$, $TR_4$ fall and the logic levels of signals $TR_3$, $TR_5$ rise, whereby registers $RE_5$, $RE_6$ are prevented from emitting signals onto leads 41', 42 whereas memory $ME_5$ and register $RE_7$ are enabled to feed back the coded algebraic values $F_2$, $E_1$ to registers $RE_3$, $RE_5$, respectively. At a subsequent instant $v_8$, clock pulses $CK_1$ and $CK_3$ induce the transfer of difference $E_1$ to register $RE_5$ and the loading of sum $F_2$ and of coefficient $K_2$ into registers $RE_3$ and $RE_4$ for transmission to multiplier $ML_3$ to form the product $\pi_{2a}$. Upon the reading of sum $F_2$ to register $RE_3$ and the emission of difference $E_1$ from register $RE_7$, signals $TR_3$, $TR_5$ assume a low level (instant $v_9$) to disconnect units $ME_5$ and $RE_5$ from output leads 41' and 42. Signals $TR_2$ and $TR_4$ then resume, at an instant $v_{10}$, their high levels for enabling the transmission of difference $E_1$ to adder $SM_3$ and of product $\pi_{2a}$ from multiplier $ML_3$ via register $RE_6$ and logic network $LN_2$ to adder $SM_3$. Because signal A/S has a high level between instants $v_{11}$ and $v_{12}$, the algebraic sign of product $\pi_{2a}$ is inverted by logic network $LN_2$ and the result loaded at instant $v_{12}$ into register $RE_7$ is a difference $E_2$. The feeding of product $\pi_{2a}$ to output register $RE_6$ is commanded by a clock pulse $CK_2$ at instant $v_{11}$, this instant terminating a first processing phase symbolized by the first filter cell $TV_1$ of FIG. 4.

Enabling signals $TR_4$, $TR_5$ go low and high, respectively, at instant $v_{12}$, thereby inhibiting further transmission from register $RE_6$ but allowing register $RE_7$ to generate on lead 42 a pulse code representing the value of difference $E_2$. An ensuing clock pulse $CK_3$ (at an instant $v_{13}$) loads the value of this difference into register $RE_5$. Owing to the high logic level of enabling signal $TR_2$, register $RE_5$ transfers difference $E_2$ to unit $RE_3$ upon the appearance of a clock pulse $CK_1$ at an instant $v_{14}$. This clock pulse also causes the loading of reflection coefficient $K_2$ into register $RE_4$. During an ensuing interval $v_{14}$–$v_{17}$, multiplier $ML_3$ forms product $\pi_{2b}$. The common output lead 41' is disconnected from register $RE_5$ and connected to memory $ME_5$ in response to the changing levels of signals $TR_2$ and $TR_3$ at an instant $v_{15}$ whereby sum $F_3$ is fed back to register $RE_3$.

At an instant $v_{16}$, signals A/S and $TR_4$ assume low and high logic levels, respectively, thereby enabling the transfer of product $\pi_{2b}$ without sign change from multiplier $ML_3$ to adder $SM_3$ upon the generation of clock pulse $CK_2$ at instant $v_{17}$. At the same instant a clock pulse $CK_1$ loads register $RE_3$ with sum $F_3$ (calculated during the processing of the preceding excitation pulse assigned to the output channel here considered) and register $RE_4$ with coefficient $K_3$, the product $\pi_{3a}$ formed from sum $F_3$ and coefficient $K_3$ being stored in register $RE_6$ at an instant $v_{21}$. Clock pulse $CK_4$ at an instant $v_{18}$ induces the temporary memorization by register $RE_7$ of the newly formed sum $F_1$. The passing, at instant $v_{18}$, of signal $TR_5$ to a high logic level enables the transmission of the new sum $F_1$ from register $RE_7$ to memory $ME_5$ upon the appearance, at an instant $v_{19}$, of a writing command in the form of a low level of signal R/W. The enabling of register $RE_7$ by signal $TR_5$ coincides with the return of changeover signal A/S to a high level, switching adder $SM_3$ to its subtractive mode, and the return of enabling signal $TR_4$ to a low level.

The subsequent processing phases of filter TV, corresponding to intermediate cells $TV_3$ to $TV_9$ omitted in FIG. 4 but indicated in FIG. 6, are the same as the operations symbolized by cell $TV_2$ occurring between instants $v_{11}$ and $v_{21}$ as described above. At an instant $v_{22}$, marking the beginning of a final calculation phase symbolized by the tenth cell $TV_{10}$, a clock pulse $CK_2$ loads product $\pi_{10a}$ into register $RE_6$. Owing to the high levels of changeover and enabling signals A/S and $TR_4$, the sign of the product is inverted in logic network $LN_2$ upon transmission thereto by register $RE_6$. Adder $SM_3$ subtracts the product $\pi_{10a}$ from the difference $E_9$ (temporarily stored in register $RE_5$) to produce the difference $E_{10}$. At an instant $v_{23}$, signals $CK_4$, $TR_4$ and $TR_5$ assume high, low and high logic levels, respectively, whereby register $RE_7$ receives difference $E_{10}$ and is enabled to transfer it to register $RE_5$ upon the appearance of a clock pulse $CK_3$ at an instant $v_{24}$. At a subsequent time $v_{25}$ a clock pulse $CK_5$ enables the transfer of difference $E_{10}$ to converter MU (see FIG. 1) and to buffer memory $ME_6$ while a clock pulse $CK_1$ loads registers $RE_3$ and $RE_4$ with difference $E_{10}$ and coefficient $K_{10}$, respectively, to be fed to multiplier $ML_3$ for the implementation of product $\pi_{10b}$. The altering of the voltage levels of signals $TR_2$, $TR_3$ at a time $v_{26}$ blocks any emission from register $RE_5$ over lead 41' and enables the transfer of sum $F_{10}$ (from the previous processing subcycle) to adder $SM_3$.

With enabling signal A/S going low and enabling signal $TR_4$ going high at an instant $v_{27}$, the appearance of a clock pulse $CK_2$ at an instant $v_{28}$ causes product $\pi_{10b}$ to be transmitted without change in sign to adder $SM_3$ for combination with sum $F_{10}$ to form a new sum $F_9$ which is then stored in register $RE_7$ in response to a pulse $CK_4$ at an instant $v_{29}$. At the latter instant the levels of signals $TR_2$ and $TR_5$ go high and the levels of signals $TR_3$ and $TR_4$ go low, whereby the new sum $F_9$ is loaded into register $RE_5$. Because signal $TR_2$ is high, a writing pulse at a time $v_{30}$ enables the transfer of sum $F_9$ to memory $ME_5$. A subsequent writing pulse (instant $v_{32}$), occurring after the appearance of a clock pulse $CK_6$ enabling the connection of memory $ME_6$ to output lead 42, causes the storage in memory $ME_5$ of difference $E_{10}$, which will serve as sum $F_{10}$ in the next processing subcycle assigned to the output channel here considered. The current subcycle terminates upon the return of signal $CK_i$ to a low logic level at a time $v_{33}$. The next subcycle begins at this time $v_{33}$ and is assigned to another output channel identified by the immediately following selection pulse $CK_a$–$CK_n$.

We claim:

1. A digital speech synthesizer comprising:

pulse-generating means for emitting excitation pulses of varying amplitudes and polarities;

a lattice filter operatively connected to said pulse-generating means for producing digital speech samples in response to said excitation pulses;

a digit-to-analog converter at an output of said filter for translating said samples into voice signals;

a programmed source of stored sets of processing parameters transmittable, in a predetermined sequence of sets, to said pulse-generating means for commanding the emission of said excitation pulses and to said filter for controlling the processing of said excitation pulses thereby, said parameters encoding information relating to frequency distribution, volume and duration of speech elements;

input means operatively connected to said pulse-generating means, to said filter and to said source for facilitating the transmission of consecutive sets of said sequence from said source to said pulse-generating means and to said filter, thereby producing consecutive speech elements of a voice signal coded by said sequence, said input means including counting means for controlling the respective durations of said consecutive speech elements according to settings for said counting means transmitted together with said parameters from said source, said setting establishing different validity intervals for said sets; and timing means operatively connected to said input means, to said filter and to said pulse-generating means for correlating the operations thereof.

2. A synthesizer as defined in claim 1 wherein said pulse-generating means includes a first generator adapted to emit digitized amplitude samples of alternating waveforms to produce voiced speech elements and a second generator adapted to emit constant-amplitude pulses free from recognizable periodicity to produce unvoiced speech elements, said parameters including a discriminating signal for selectively enabling either one of said generators.

3. A synthesizer as defined in claim 2 wherein said input means includes a plurality of input units associated with respective output channels, said timing means being connected to said input units for individually activating same one at a time, said timing means controlling said pulse-generating means and said filter in a time-division mode.

4. A synthesizer as defined in claim 3, further comprising a control unit forming an interface between said source and said input units for temporarily storing parameter-set requests therefrom and for distributing parameter sets from said source to respective input units selected according to address information supplied by said source.

5. A synthesizer as defined in claim 3 or 4 wherein each of said input units further includes a pair of buffer memories for temporarily and alternately storing successive parameter sets from said source, said counting means being connected to said memories for enabling an interchange of reading and writing functions therebetween upon detecting the termination of a current validity interval.

6. A synthesizer as defined in claim 5 wherein said counting means includes a validity-interval counter and further includes a sound-interval counter for determining the end of voiced intervals and of unvoiced intervals; said input means further comprising a switch operating in response to said discriminating signal, stored in either of said buffer memories, to control the loading of said sound-interval counter with unvoiced-interval settings corresponding to the contents of said validity-interval counter and with pitch-period settings stored in either of said buffer memories representing frequency characteristics of voiced speech elements, and an additional memory for temporarily storing filter coefficients and sound-intensity data transmitted from said buffer memories in response to a reading signal generated by said sound-interval counter upon detecting the termination of a current sound interval, said additional memory being responsive to clock pulses from said timing means for transmitting said coefficients to said filter.

7. A synthesizer as defined in claim 4 wherein said control unit includes a logic network for enabling the transfer of a parameter request from an input unit to said source only upon receiving therefrom consent signals indicating completion of an ongoing transmission of a parameter-set sequence to such input unit.

8. A synthesizer as defined in claim 7 wherein said control unit further includes register means for temporarily storing parameters for said source and a series-to-parallel converter for decoding address signals received from said source to enable the transmission of parameters from said register means to a selected input unit.

9. A synthesizer as defined in claim 7 wherein said control unit further includes a parallel-to-series converter for encoding addresses of request-emitting input units and a read/write memory at the output of said parallel-to-series converter for temporarily storing said addresses prior to emission thereof to said source in response to a ready signal therefrom.

10. A synthesizer as defined in claims 1, 2, 3, 4, 7, 8 or 9 wherein said filter includes a digital multiplier, a digital adder and storage means for generating a digital speech sample as a sum of terms including an excitation sample weighted by a sound-intensity coefficient and at least one term formed as a product between a reflection coefficient and a preceding digital speech sample.

* * * * *

UNITED STATES PATENT AND TRADEMARK OFFICE

CERTIFICATE OF CORRECTION

PATENT NO. : 4 319 084

DATED : 9 March 1982

INVENTOR(S) : Paolo Lucchini et al

It is certified that error appears in the above-identified patent and that said Letters Patent are hereby corrected as shown below:

In the heading, left column, item [75], please insert the names of the third and fourth inventors: -- Giovanni Ponte, Torino; Enrico Vivalda, Torino --; and change "both" to -- all --.

Signed and Sealed this

*Twelfth* Day of *October 1982*

[SEAL]

*Attest:*

GERALD J. MOSSINGHOFF

*Attesting Officer*

*Commissioner of Patents and Trademarks*